US005436409A

United States Patent [19]

Sawada et al.

[11] Patent Number: 5,436,409

[45] Date of Patent: Jul. 25, 1995

[54] ELECTRICAL CONDUCTOR MEMBER SUCH AS A WIRE WITH AN INORGANIC INSULATING COATING

[75] Inventors: Kazuo Sawada; Shinji Inazawa; Kouichi Yamada, all of Osaka, Japan

[73] Assignee: Sumitomo Electric Industries, Ltd., Osaka, Japan

[21] Appl. No.: 93,315

[22] Filed: Jul. 16, 1993

Related U.S. Application Data

[63] Continuation-in-part of Ser. No. 811,460, Dec. 19, 1991.

[30] Foreign Application Priority Data

Jan. 10, 1991 [JP] Japan ..... 3-1645

[51] Int. Cl.[6] ..... H01B 7/00

[52] U.S. Cl. ..... 174/120 C; 174/110 A; 174/126.2; 428/384; 428/469; 428/623; 428/680

[58] Field of Search ..... 174/110 A, 110 R, 120 R, 174/120 C, 126.2; 428/623, 671, 680, 627, 675, 469, 688, 457, 384

[56] References Cited

U.S. PATENT DOCUMENTS 2,010,145 8/1935 Eitel ..... 65/59.2
2,975,078 3/1961 Rayfield et al. ..... 174/110 A

FOREIGN PATENT DOCUMENTS 0012422 6/1980 European Pat. Off. ..... 174/120 R
292780 11/1988 European Pat. Off. .
2301909 2/1991 Japan .
2220295 1/1990 United Kingdom .

*Primary Examiner*—Morris H. Nimmo
*Attorney, Agent, or Firm*—W. G. Fasse; W. F. Fasse

[57] ABSTRACT

An insulated electrical conductor wire has a conductor core containing Ni or Ni alloy at least in its outer surface, an oxide layer of Ni or Ni alloy formed by oxidation treatment of the outer surface of the conductor, and an insulating inorganic compound outer layer formed on the oxide layer of Ni or Ni alloy. The insulating inorganic outer layer is intimately bonded to the oxide layer and provides an improved heat resistance and insulability.

17 Claims, 2 Drawing Sheets

ELECTRICAL CONDUCTOR MEMBER SUCH AS A WIRE WITH AN INORGANIC INSULATING COATING

CROSS-REFERENCE TO RELATED APPLICATION

This application is a Continuation-in-part of U.S. application Ser. No. 07/811,460, filed on Dec. 19, 1991, and entitled: "ELECTRICAL CONDUCTOR WIRE WITH AN INORGANIC INSULATING COATING".

FIELD OF THE INVENTION

The present invention relates to an electrically conducting wire with an insulating coating made of an inorganic material. Such a wire is used for high temperature operating conditions, e.g. as an insulated lead wire or the like.

BACKGROUND INFORMATION

An insulated conductor such as a wire or a member for a thermocouple is generally applied used in equipment such as heating equipment or fire alarm devices, which require safe operation oat high operating temperatures. Such an insulated wire is also employed in an automobile in an environment which is heated to a high temperature. An insulated wire of this type is generally formed by a conductor which is coated with a heat-resistant organic resin such as polyimide, fluororesin or the like. Such a resin-coated wire can merely withstand a temperature of about 300° C. at the most. However, a wire which is employed in a high vacuum apparatus, for example, must have high heat resistance against baking, etc., a small emission characteristic as to absorbed gas and water for achieving and maintaining a high degree of vacuum, and a small emission of gases caused by thermal decomposition. It is impossible to satisfy such requirements for heat resistance and a non-outgassing property with a conventional wire which is coated with an organic material insulation.

When an insulated wire is used where a high heat resistance is required or in an environment requiring a high degree of vacuum, it is impossible to attain a sufficient heat resistance nor the required non-outgassing property with only an organic coating. In that case, therefore, an insulated wire comprising a conductor which passes through an insulator tube of ceramics, an MI (mineral insulated) cable comprising a conductor which passes through a tube of a heat-resistant alloy, such as stainless steel alloy, that is filled with fine particles of a metal oxide such as magnesium oxide, or the like is generally used.

On the other hand, a glass braided tube insulated wire employing an insulating member of glass fiber fabric or the like is known as an insulated, heat resistant, flexible wire.

Further, wires coated with organic materials were studied. As a result wires have been proposed, one of which is obtained by anodizing an aluminum copper (Cu) or nickel (Ni) conductor for forming an Al oxide layer on the outer wire surface, and another wire is obtained by mixing a frit prepared by mixing various metal oxides with each other and melting and pulverizing the as-obtained mixture for forming a slip, applying this slip to a metal conductor and heating and melting the same for forming a homogeneous composite metal oxide layer or coating on the wire surface.

However, the wire with an aluminum oxide layer is not suitable for use as a heat resistant wire since this technique is merely applicable to an aluminum conductor having a low melting point, while the as-formed film is so porous that the wire has an inferior moisture resistance and a low breakdown voltage.

On the other hand, the wire with a copper nickel oxide coating is applicable to a metal conductor of copper (Cu) or nickel (Ni) having a higher heat resistance. In practice, however, this technique is merely applicable to a metal composite oxide whose melting point is lower by about 300° to 400° C. than those of Cu and Ni since the metal composite oxide layer is formed through a melting process, and the heat resistance temperature is restricted below the just mentioned level. Further, the as-formed wire is inferior in flexibility since it is difficult to reduce the thickness of the film.

In the case of the MI cable, on the other hand, the overall diameter is increased as compared with the conductor diameter, leading to an inferior space factor. Thus, it is impossible to feed a high current.

In the glass braided tube insulated wire, further, fine glass powder is generated and the conductor is disadvantageously exposed due to mesh displacement.

SUMMARY OF THE INVENTION

It is an object of the present invention to provide an inorganic insulated member such as an electric conductor wire which has an excellent heat resistance and insulability.

The inorganic insulating member or electrical conductor wire according to the present invention comprises a conductor of Ni or Ni alloy, an oxide layer of an oxide at the Ni or Ni alloy on an outer surface of the conductor, said oxide layer being obtained by oxidizing the conductor in a vapor phase containing oxygen, and an oxide layer of aluminum (Al) and or silicon (Si) provided on an outer face of the oxide layer of Ni or Ni alloy.

According to the present invention, the oxide layer of Al and/or Si is an oxide layer obtained by applying a solution prepared by hydrolyzing and polycondensing alkoxide of Al and/or Si in a solvent, drying the same for allowing gelation, and thereafter heating the obtained gel.

According to the present invention, further, the oxide layer of Al and/or Si has a melting point exceeding that of Ni or Ni alloy.

The inorganic insulated member according to the present invention is applied to or used as a heat resistant wire or an incombustible wire at a high temperature which does not permit using an organic insulating material, for example. However, the present invention is not restricted to such a wire, but is also applicable to another member such as a thermocouple.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION AND OF TWO COMPARATIVE EXAMPLE EMBODIMENTS

Figure 1:
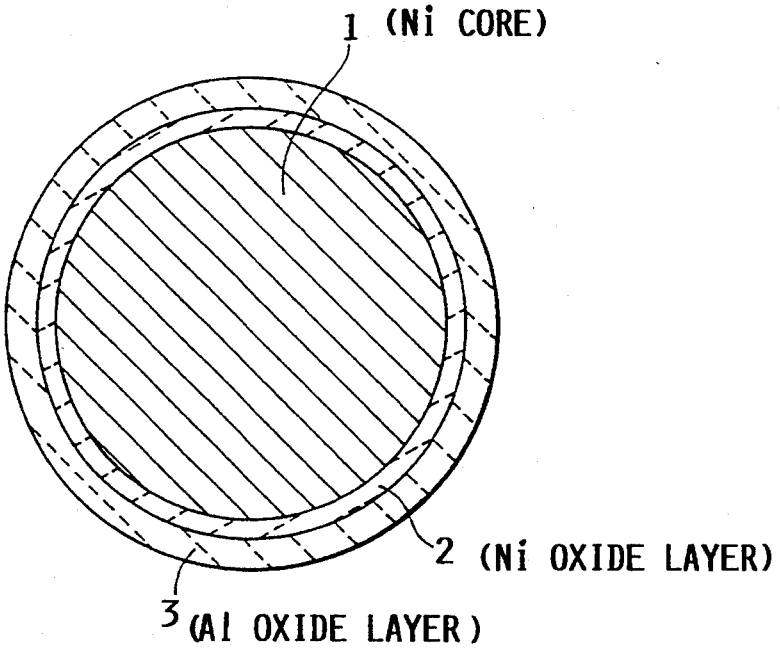
FIG. 1 is a sectional view showing a first embodiment of the present invention with a nickel conductor core and two oxide layers.

FIG. 1 shows an Ni core conductor 1 coated with an Ni oxide layer 2 formed around the core conductor. An Al oxide layer 3 is formed around the Ni oxide layer 2. The formation of these oxide layers will be described in more detail below.

Figure 2:
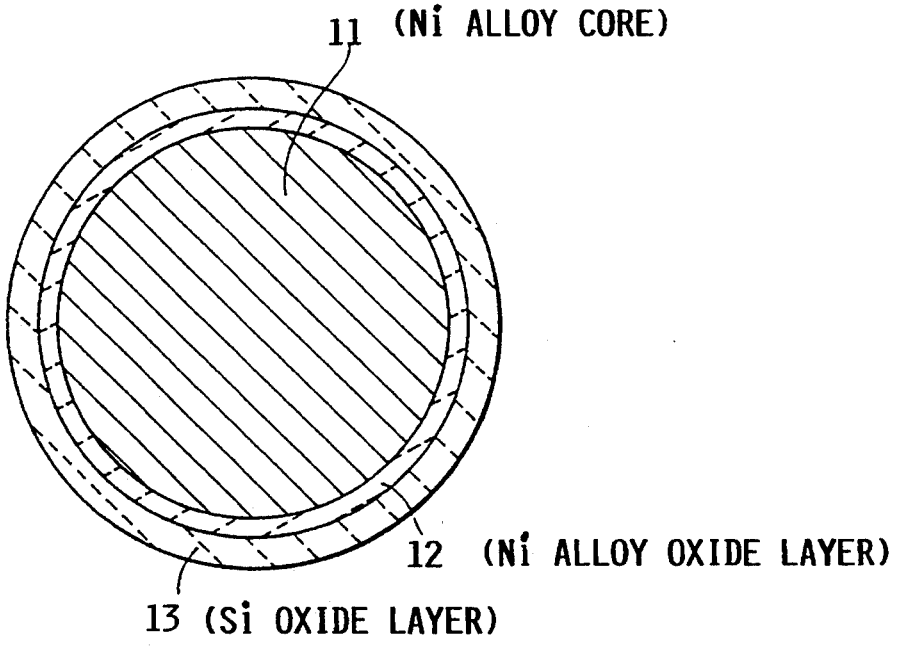
FIG. 2 is a sectional view showing a second embodiment of the present invention with a nickel alloy core conductor and two oxide layers.

FIG. 2 shows a nickel alloy conductor 11 first coated with an Ni alloy oxide layer 12 formed around the Ni alloy conductor 11. An Si oxide layer 13 is formed around the Ni alloy oxide layer 12.

Figure 3:
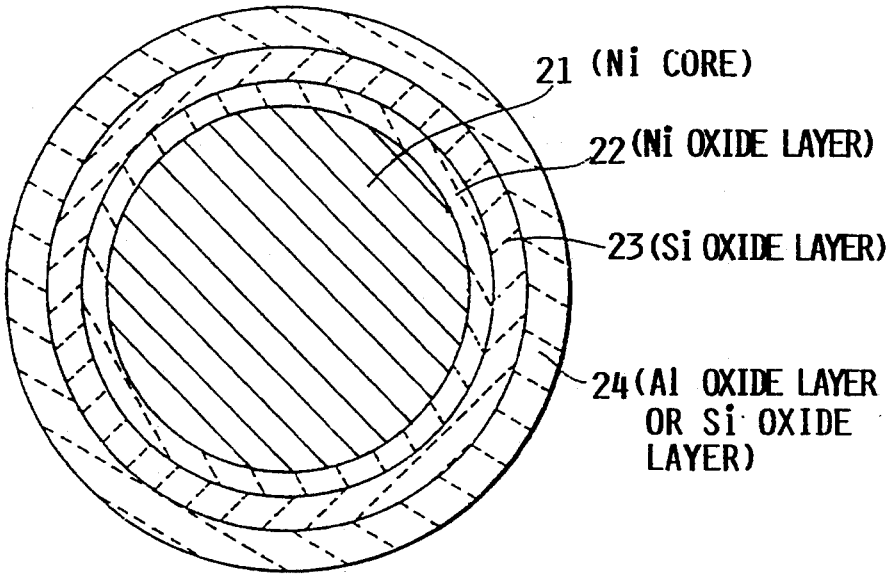
FIG. 3 is a sectional view showing a third embodiment of the present invention with a nickel core conductor and three oxide layers.

In FIG. 3 the nickel Ni core conductor 21 is first coated with an Ni oxide layer 22 formed around the Ni core conductor 21. An Si oxide layer 23 is formed around the Ni oxide layer 22. Then, an Al oxide layer or Si oxide layer 24 is formed around the Si oxide layer 23.

Figure 4:
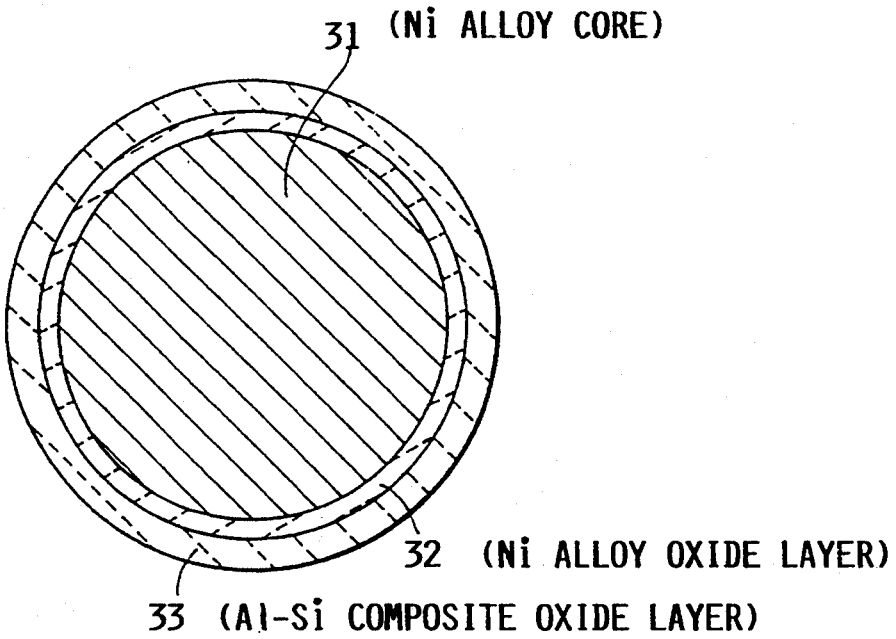
FIG. 4 is a sectional view showing a fourth embodiment of the invention with a nickel alloy core conductor and two oxide layers.

In FIG. 4, a nickel alloy core conductor 31 is first coated with an Ni alloy oxide layer 32 formed around the Ni alloy core conductor 31. Then, an Al-Si composite oxide layer 33 is formed around the Ni alloy oxide layer 32.

According to the present invention, a first oxide layer of Ni or an Ni alloy is first formed on an outer surface of a conductor of Ni or Ni alloy by oxidizing the conductor in a vapor phase containing oxygen. Then, a second oxide layer of Al and/or Si is formed on the first oxide layer.

Ni or Ni alloy is an inactive metal which has an inferior affinity for a metal oxide of Al or Si. When a surface of Ni or Ni alloy is directly coated with such an Al or Si oxide, a rather poor adhesion is obtained and the coating is immediately separated from the Ni or Ni alloy. In order to solve this problem, the present invention teaches to first oxidize a core conductor of Ni or Ni alloy in a vapor phase containing oxygen so as, to form an oxide layer of Ni or Ni alloy. The so formed nickel oxide layer or Ni alloy oxide layer very strongly adheres to the surface of the Ni or Ni alloy. This strong bonding is due to the fact that the nickel oxide or the nickel alloy oxide has an excellent affinity for the nickel or nickel alloy. Additionally, the nickel or nickel alloy oxide has a strong affinity to aluminum oxide or silicon oxide and hence also strongly bonds to the outer layer of Al or Si oxide and to the conductor core. According to the present invention, therefore, the oxide layer of Al and/or Si is not separated for all practical purposes from the intermediate oxide layer, whereby an excellent flexibility is obtained when the inorganic insulating coating is applied to a wire forming a core conductor, for example.

According to the present invention, the oxide layer of Al and/or Si is obtained by applying a solution prepared by hydrolyzing and polycondensing an alkoxide of Al and/or Si in a solvent, drying the same for allowing gelation, and thereafter heating the so-obtained gel.

The Al and/or Si oxide layer formed in the aforementioned manner has a melting point exceeding that of the Ni or Ni alloy. Additionally, the Al and/or Si oxide layer is formed without any melting process.

Therefore, the critical temperature to which conductors or other members of the present invention with their inorganic insulating coatings may be exposed in operation is not restricted by the melting point of the oxide layer. Rather, the present insulating members can be heated to a temperature limited only by the melting point of the Ni core or the Ni alloy core.

Further, the oxide layer formed in the aforementioned manner has characteristics such as an extreme denseness, a smooth surface and a small adsorption of gases, e.g. steam or the like. Moreover, the present members have an excellent insulability and a high moisture resistance.

Preferred embodiments have been produced as two conductors C1 and C2 which were oxidized as follows.

(C1) An Ni wire of 0.5 mm in diameter consisting of at least 99.9 percent by weight of Ni, the remainder being natural impurities was heated in the atmosphere at 950° C. for 10 minutes, to form a nickel oxide layer on the surface of the wire.

(C2) An Ni alloy wire of 0.5 mm in diameter containing 15 percent by weight of Cr was heated in the atmosphere at 850° C. for 30 minutes, to form an oxide layer of Ni alloy on the wire surface.

The following coating solutions L1, L2 and L3 were prepared as follows:

(L1) A solution L1 was obtained by mixing tributoxy aluminum, triethanolamine, water, and isopropyl alcohol in mole ratios of 1:2:1:16. The mixture was hydrolyzed and polycondensed at 50° C. for 1 hour while stirring the mixture.

(L2) A solution L2 was obtained by adding nitric acid to a mixed solution prepared by mixing tributyl orthosilicate, water, and isopropyl alcohol in mole ratios of 2:8:15 at a rate of 3/100 moles with respect to tetrabutyl orthosilicate. The mixture was hydrolyzed and polycondensed at 80° C. for 2 hours while stirring the mixture.

(L3) A solution L3 was obtained by mixing the solutions L1 and L2 at a mass ratio of 80:20.

Example 1

An oxidized nickel conductor C1 was coated with the coating solution L1 and heated at 500° C. for 10 minutes. The coating and heating was repeated 10 times, to form an Al oxide layer of 4 μm thickness on the first nickel oxide layer.

Example 2

An oxidized nickel alloy conductor C2 was coated with the coating solution L2 and heated at 500° C. for 10 minutes. The coating and heating was repeated 10 times, to form an Si oxide layer of 5 μm thickness on the first nickel alloy oxide layer.

Example 3

An oxidized nickel conductor C1 was coated with the coating solution L2 and heated at 500° C. for 10 minutes.

The coating and heating was repeated 5 times to form an Si-oxide layer having a thickness of 2.5 μm. Then, a further coating operation was performed on the first formed Si-oxide layer, with the coating solution L1. The sample was again heated at 500° C. for 10 minutes. The coating and heating was repeated 5 times to form an Al oxide layer of 2 μm thickness on the first formed Si oxide layer of 2.5 μm thickness.

Example 4

An oxidized conductor C2 was coated with the coating solution L3 and heated at 500° C. for 10 minutes. The coating and heating was repeated 10 times to form an Al-Si composite oxide layer of 6 μm in thickness.

Comparative Example 1

An aluminum wire was anodized in a bath of sulfuric acid to form an Al oxide layer of 10 μm thickness on the aluminum surface.

Comparative Example 2

An oxidized conductor C2 was coated with a slip which was prepared by mixing a commercially available frit (composite oxide of Ba, Ca, Ti and Si: GSP220A552 sold by Toshiba Glass Co., Ltd.) with water. The wire coated with the slip was heated to 900° C. to form a homogeneous metal composite oxide layer of 100 μm thickness through a melted state.

All the coating operations were, for example, performed by dipping the wire into the respective coating solution.

| Example | Test Results Breakdown Voltage | Flexibility |
|---|---|---|
| 1 | 500 V | 6 D |
| 2 | 600 V | 5 D |
| 3 | 800 V | 8 D |
| 4 | 400 V | 3 D |
| Comparative Example 1 | 300 V | 50 D |
| Comparative Example 2 | 1200 V | 1000 D |

The above Table shows the breakdown voltages and the flexibility values of the wires of Examples 1 to 4 of the invention and of the two Comparative Examples. The flexibility values were evaluated in terms of diameter ratios, by winding the wires on circular cylinders of a prescribed diameter D and measuring the minimum diameters causing no separation of the insulating inorganic compound coatings or layers from the conductor core. The diameter D was 0.5 mm.

The above Table shows that the wires of Examples 1 to 4 according to the present invention have a higher breakdown voltage than the first Comparative Example and a superior flexibility compared to both Comparative Examples. However, the second Comparative Example has a substantially higher breakdown voltage at the expense of being very stiff.

As hereinabove described, the inorganic insulating coating on a conductor wire according to the present invention forms an insulating inorganic compound layer which is well bonded to the conductor core and has an excellent heat resistance and insulability.

Although the invention has been described with reference to specific example embodiments, it will be appreciated that it is intended to cover all modifications and equivalents within the scope of the appended claims.

What we claim is:

1. An insulated electrical conductor comprising a core conductor consisting essentially of a core material selected from the group consisting of Ni and Ni alloy, a first oxide layer consisting of an oxide of said core material formed on an outer surface of said core conductor by oxidizing said core conductor in a vapor phase containing oxygen, and a second oxide layer bonded to an outer surface of said first oxide layer, said second oxide layer consisting essentially of an inorganic insulating material selected from the group consisting of Al-oxide and Si-oxide and combinations thereof.

2. The insulated electrical conductor of claim 1, wherein said second oxide layer has a melting temperature greater than that of said core material.

3. The insulated electrical conductor of claim 1, further comprising a third oxide layer on an outer surface of said second oxide layer, said third oxide layer consisting essentially of a third oxide material selected from the group consisting of Al-oxide and Si-oxide.

4. The insulated electrical conductor of claim 3, wherein said third oxide layer consists essentially of a different material than does said second oxide layer.

5. The insulated electrical conductor of claim 4, wherein said third oxide layer consists essentially of Al-oxide and said second oxide layer consists essentially of Si-oxide.

6. The insulated electrical conductor of claim 1, wherein said core conductor consists of Ni and trace amounts of naturally occurring impurities.

7. The insulated electrical conductor of claim 1, wherein said core conductor consists essentially of Ni and Cr.

8. The insulated electrical conductor of claim 7, wherein said core conductor consists essentially of about 85 percent Ni and about 15 percent Cr.

9. A method of forming an insulated electrical conductor, comprising:

(a) preparing a core conductor of a core material selected from the group consisting of Ni and Ni alloy;

(b) forming a first oxide layer on an outer surface of said core conductor by oxidizing said core conductor in a vapor phase containing oxygen;

(c) preparing a coating solution by hydrolyzing and polycondensing an alkoxide of a member selected from the group consisting of Al, Si and combinations thereof in a solvent;

(d) applying said coating solution onto said first oxide layer;

(e) drying said coating solution for gelling the same; and (f) heating said coating solution applied onto said first oxide layer to form a second oxide layer on said first oxide layer.

10. The method of claim 9, further comprising repeating said steps (d) to (f) a plurality of times, whereby successive coating films of said coating solution are applied one on top of another to form said second oxide layer.

11. The method of claim 9, wherein said step (f) does not involve a melting process.

12. The method of claim 9, further comprising preparing a second coating solution by hydrolyzing and polycondensing an alkoxide of a second member selected from said group consisting of Al, Si and combinations thereof in a solvent, applying said second coating solution onto said second oxide layer and heating said second coating solution to form a third oxide layer on said second oxide layer.

13. The method of claim 9, wherein said coating solution is prepared by forming a mixture of tributoxy aluminum, triethanolamine, water and isopropyl alcohol, and then hydrolyzing and polycondensing said mixture.

14. The method of claim 13, wherein the respective mole ratio of said tributoxy aluminum, triethanolamine, water and isopropyl alcohol is 1:2:1:16, and said hydrolyzing and polycondensing is carried out at 50° C. for 1 hour while stirring said mixture.

15. The method of claim 9, wherein said coating solution is prepared by forming a mixture of tributyl orthosilicate, water and isopropyl alcohol, adding nitric acid to said mixture, and then hydrolyzing and polycondensing said mixture with said nitric acid added thereto.

16. The method of claim 15, wherein the respective mole ratio of said tributyl orthosilicate, water and isopropyl alcohol is 2:8:15, said nitric acid is added at a rate of 3/100 moles with respect to tetrabutyl orthosilicate, and said hydrolyzing and polycondensing is carried out at 80° C. for 2 hours while stirring said mixture.

17. The method of claim 9, wherein said heating step is carried out at about 500° C.

* * * * *

UNITED STATES PATENT AND TRADEMARK OFFICE

CERTIFICATE OF CORRECTION

PATENT NO. : 5,436,409
DATED : July 25, 1995
INVENTOR(S) : Sawada et al

It is certified that error appears in the above-indentified patent and that said Letters Patent is hereby corrected as shown below:

```
Column 1, line 24, delete "applied";
          line 26, replace "oat" by --at--;
          line 32, after "like." insert paragraph spacing;
          line 62, replace "aluminum copper" by --aluminum (Al)--
          line 63, delete "(Cu) or nickel (Ni)";
Column 2, line 9,  replace "copper nickel" by --composite metal--
          line 40, replace "face" by --surface--;
          line 59, after "BRIEF DESCRIPTION OF THE DRAWINGS"
          insert a paragraph spacing;
Column 3, line 44, after "oxygen" insert --,--, delete "," after
                   "as".
```

Signed and Sealed this

Twenty-fourth Day of October, 1995

*Attest:*

*Attesting Officer*

BRUCE LEHMAN

*Commissioner of Patents and Trademarks*